United States Patent [19]

Tsuji et al.

[11] Patent Number: 4,733,990

[45] Date of Patent: Mar. 29, 1988

[54] ERECTING/LYING-DOWN DAM OR SLUICE GATE MADE OF FLEXIBLE SHEET

[75] Inventors: Yoshiomi Tsuji; Ichiro Maruyama; Hiroshi Takuma, all of Osaka, Japan

[73] Assignee: Sumitomo Electric Industries, Ltd., Osaka, Japan

[21] Appl. No.: 73,197

[22] Filed: Jul. 14, 1987

Related U.S. Application Data

[62] Division of Ser. No. 880,663, Jun. 30, 1986.

[30] Foreign Application Priority Data

Aug. 21, 1985 [JP] Japan ..... 60-184875
Aug. 21, 1985 [JP] Japan ..... 60-184876

[51] Int. Cl.[4] ..... E02B 7/20; E02B 7/02
[52] U.S. Cl. ..... 405/115; 405/91
[58] Field of Search ..... 405/115, 91, 80, 87, 405/107

[56] References Cited

U.S. PATENT DOCUMENTS 2,609,666 9/1952 Mesnager ..... 405/115
3,173,269 3/1965 Imbertson ..... 405/115 X

FOREIGN PATENT DOCUMENTS 1265063 3/1968 Fed. Rep. of Germany ..... 405/91
0133916 8/1982 Japan ..... 405/115
2077825 12/1981 United Kingdom ..... 405/115

*Primary Examiner*—Dennis L. Taylor
*Attorney, Agent, or Firm*—Cushman, Darby & Cushman

[57] ABSTRACT

A dam with a flexible cover attached to a bottom sheet by fittings with corrugations formed between the fittings so that upon deflation the cover conforms to the surface of the corrugations, minimizing any floating cover portion. The corrugations may be formed as pipe-like members, as molded portions integral with the bottom sheet or as part of the concrete foundation. Preferably the length between the fittings measured along the corrugation surfaces is at least 1.1 times the linear length therebetween. The corrugations are also preferably recessed to extend no higher than the bottom of the riverbed.

21 Claims, 10 Drawing Figures

ERECTING/LYING-DOWN DAM OR SLUICE GATE MADE OF FLEXIBLE SHEET

This is a division of application Ser. No. 880,663, filed June 30, 1986.

BACKGROUND OF THE INVENTION

The present invention relates to an erecting/lying-down dam or sluice gate made of a flexible sheet.

Erecting/lying-down dams or sluice gates are typically made of a flexible film (for example, rubberized fabric) attached on a riverbed at least in a direction intersecting the river flow with a fluid such as air, water or the like acting as an expanding medium. The medium is discharged from the cover to make the cover lay down through a pumping pipe communicating with the inside of the cover. Such devices are described in Japanese Patent Publication Nos. 40-11702 and 44-2371.

FIG. 1(*a*) shows such a prior art erecting/lying-down dam or sluice gate made of a flexible film as described above. In the drawing, reference numeral 1 designates a flexible film forming a cover, 2 a foundation of concrete, 3 a watertight sheet forming a base, 4 fittings connecting cover 2 and base 3, 5 air or water inflating the gate, and 6 a stream of water in a river or the like.

Where water exists also at the downstream side, film cover 1 does not completely lay down on foundation 2 when deflating; that is, a floating film F is produced as shown in FIG. 1(*c*). Of course film 2 does not float if there is no water or little water at the downstream side. FIG. 1(*b*) shows a midway state where fluid is being discharged.

When the foregoing dam is inflated as an estuary dam, a temporarily shut-up dam, a lock gate, or the like, of course the dam prevents a ship from navigating. However, navigation is not always possible even when the dam is deflated. There is a possibility of damage of a floating film as described above by a ship by its body or screw. Even if the floating film is lying down, there is another possibility of damage by being rolled up by a screw.

SUMMARY OF THE INVENTION

According to the present invention, an erecting/lying-down dam or sluice gate is made with a cover of the flexible film attached by two rows of fittings at least onto a bottom portion of a river or the like in a direction intersecting a stream of the river and air or water is pumped into and out of the inside of the cover to expand and deflate it. Corrugations are provided on the lower interior surface between the rows of fittings so that the flexible film of the cover contacts the surface of the corrugations to minimize or eliminate the length of any floating film portion of the cover when the dam or sluice gate lies down.

BRIEF DESCRIPTION OF THE DRAWINGS

FIG. 1(*a*), (*c*) and (*b*) show the state where the cover is expanded, the state where the cover is deflated, and the state midway between states (a) and (c).

FIG. 4(*a*) and (*b*) show the state where the cover is expanded and the state where the cover is deflated respectively.

DETAILED DESCRIPTION OF THE PREFERRED EMBODIMENTS

Preferred embodiments of the present invention will be described with reference to the accompanying drawings.

Figure 1A:
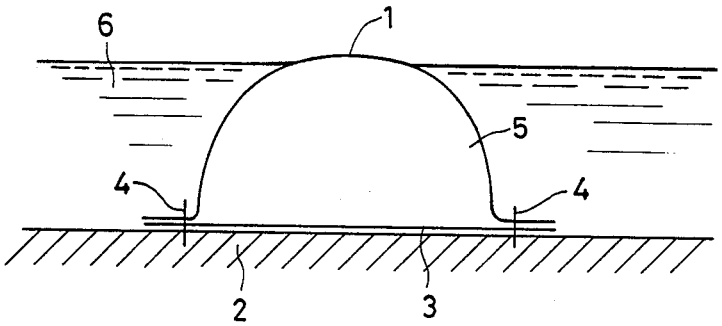
FIG. 1 is a transverse cross-section illustrating the conventional prior art erecting/lying-down dam or sluice gate made of a flexible film.
Figure 1B:
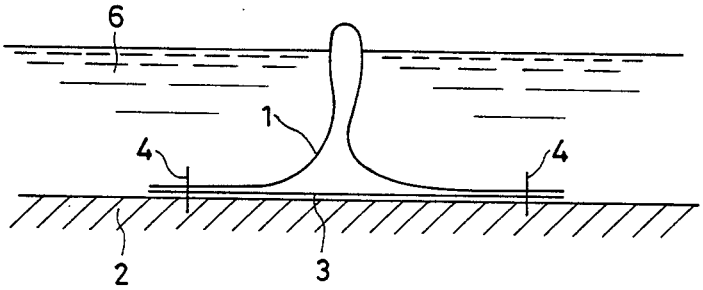
Figure 1C:
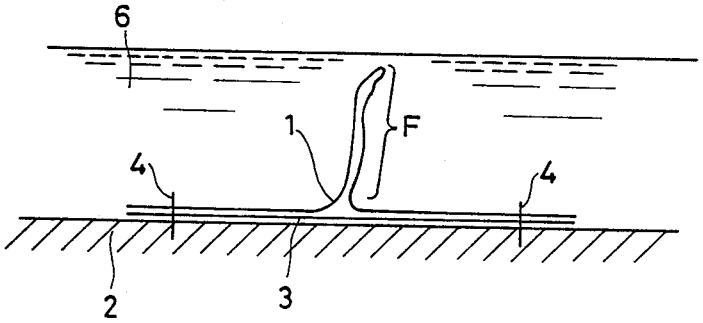
Figure 2A:
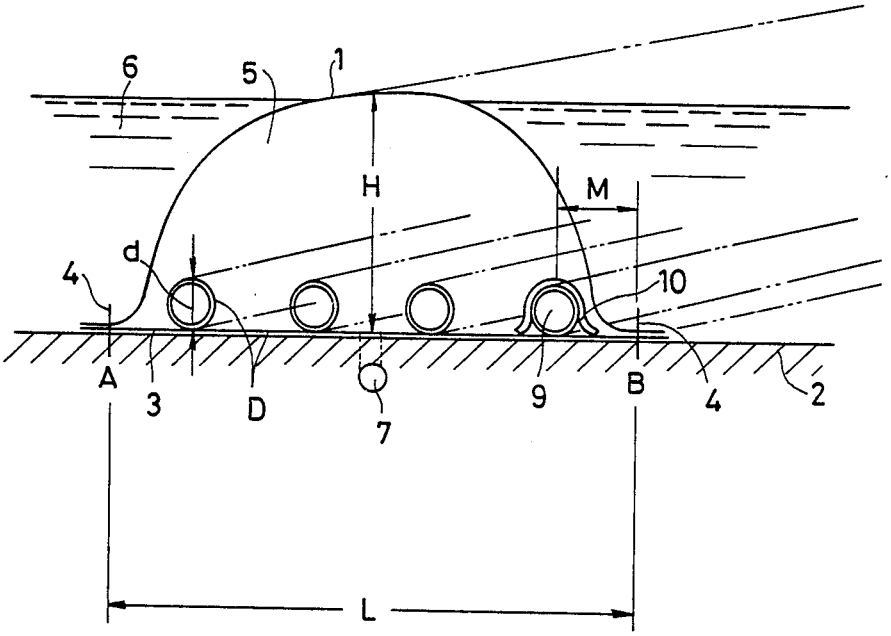
FIG. 2(a) and (b) show the state where the cover is expanded and the state where the cover is deflated respectively.
Figure 2B:
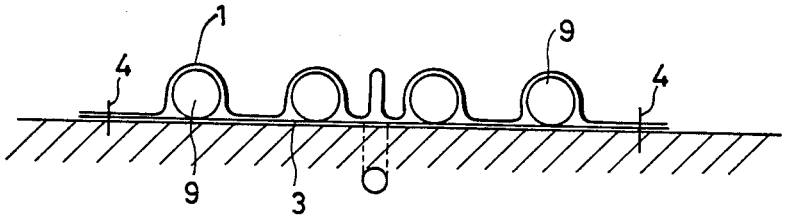
FIG. 2(*a*) and (*b*) and FIG. 3 are cross-sections illustrating an erecting/lying-down dam or sluice gate made of a flexible film according to the first and second embodiments of the present invention, respectively.

FIG. 2(*a*) and (*b*) show an embodiment according to the present invention. Reference numeral 1 designates a flexible film such as a rubberized fabric forming a cover, 2 a foundation of concrete, 3 a watertight sheet forming a base, 4 fittings connecting cover 1 and sheet 3, 5 air or water inflating the base, 6 a stream of water in a river or the like, and 7 a mouth for pumping.

According to the first embodiment of the present invention, the dam is specifically made in the following manner. First, attaching lines forming fittings are arranged in two rows A and B. Next, corrugation forming members 9 are placed on the watertight sheet 3 between the attaching lines A and B, so that the members 9 and the sheet 3 constitute in combination a watertight sheet integrally provided with a corrugated upper surface D.

As the above-mentioned corrugation forming member, a cylindrical member such as a pipe (for example, an iron pipe, a pipe of vinyl chloride, a rubber pipe, or the like), a rod, or the like, having rigidity which is large enough not to be crushed down by the depth of water at a dam location can be used. In FIG. 2, reference numeral 10 designates a holder for holding the corrugation forming member in place on base sheet 3. Further, the foregoing corrugations D are usually formed parallel to the above-mentioned attaching direction.

As described above, according to the first embodiment of the present invention, corrugation forming members are disposed on the surface of a watertight sheet to form corrugations thereon, so that the actual length (represented by AB) measured along the surface of corrugations between A and B is longer than the linear distance or linear length between A and B (represented by AB). Accordingly, it is possible to shorten or obviate the floating length of a flexible film in the conventional art because the flexible film lies along the surface AB owing to the external pressure against the cover which is higher than the internal pressure of the same when the dam lies down. This state is shown in FIG. 2(*b*).

To achieve satisfactory shortening or elimination of the floating length of the film the condition $AB \geqq 1.1 \times AB$ should be at least satisfied.

Figure 6:
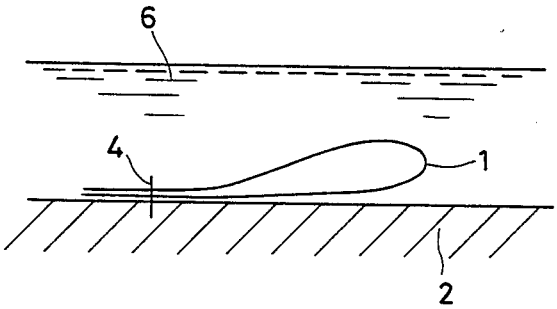
FIG. 6 is a diagram for explaining that there is no effect in the case where the cover attaching is made in a single row even if corrugations are provided according to the present invention.

If the attaching line is provided only by one row, the cover may take such an attitude as shown in FIG. 6 when the dam has laid down, so that there is no action of pressing down the cover.

The construction of FIG. 2, was tested with the cover deflated (air was used as the expanding medium)

with the length (H) of the cover 1 as 1.8 m, the attaching interval (L) between A and B was 3.74 m, the diameter (d) of each of the corrugation forming member 9 (pipes were used) was 0.3 m $\phi$ (four members 9 are disposed equidistantly, and the distance (M) was 0.45 m). The film of the cover fitted well on the surface of the corrugations, so that no floating film was generated.

Figure 3:
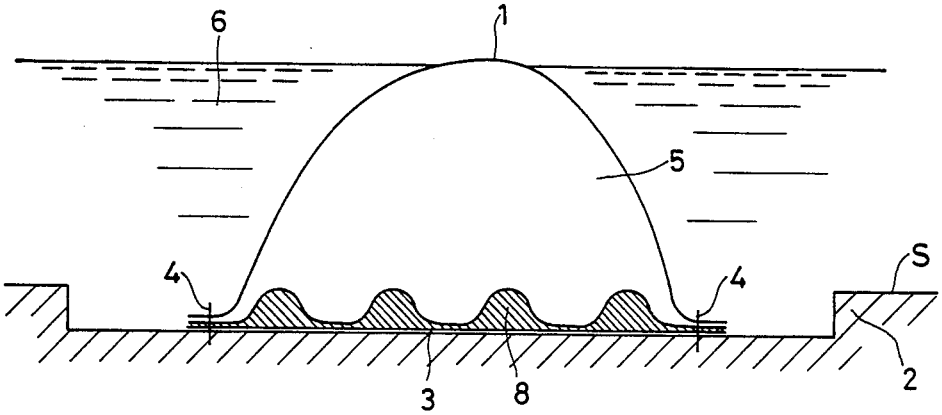

FIG. 3 shows a second embodiment of the present invention. Elements corresponding functionally to those in the first embodiment are designated by like reference numerals or characters. In this embodiment, instead of arranging the corrugation forming members on the watertight sheet as shown in FIG. 2, the corrugations D are provided by molded rubber or plastic raised portions 8 formed as a separate member or integrally with the rubber- or plastic-coated fabric of the watertight sheet 3. Furthermore, since the dam is recessed below the riverbed with the corrugated surface portion extending no higher than the riverbed, there is no risk of damage to the film by a screw or the like because the deflated film does not extend beyond the surface S of the body of the foundation concrete.

Figure 4A:
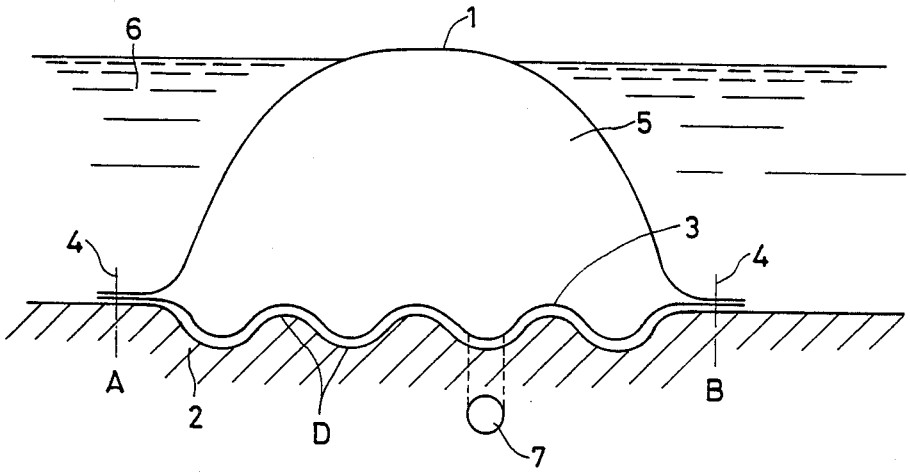
FIG. 4(*a*) and (*b*) and FIG. 5 are cross-sections for illustrating an erecting/laying-down dam or sluice gate made of a flexible film according to the third and fourth embodiments of the present invention, respectively.
Figure 4B:
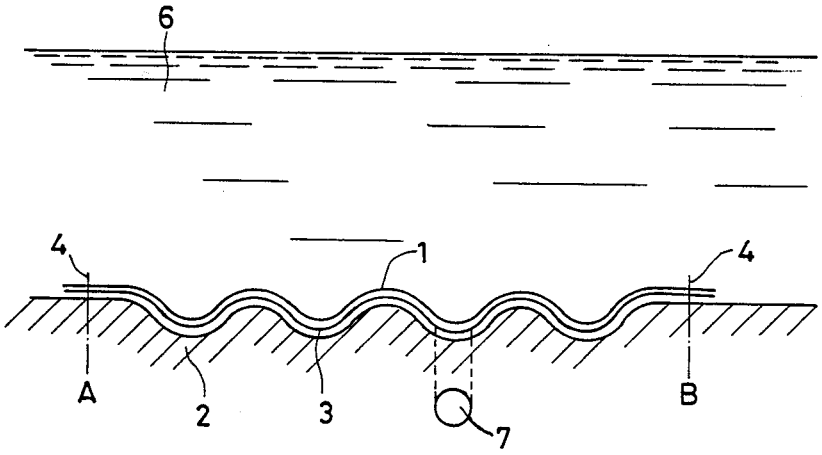

FIG. 4(*a*) and (*b*) show a third embodiment of the present invention. Elements corresponding functionally to those in the first and second embodiments are designated by like reference numerals or characters.

According to the third embodiment of the present invention, first, attaching lines constituted by fittings are arranged in two rows A and B, as described in the first and second embodiments. Next, corrugations D are formed on the upper surface of the foundation concrete between the attaching lines A and B. Usually, the corrugations D are made to be parallel with the above-mentioned attaching direction.

Thus, corrugations are formed on the foundation concrete, so that the actual length (represented by AB) measured along the surface of corrugations between A and B is longer than the linear distance or linear length between A and B (represented by AB). Accordingly, it is possible to shorten or obviate the floating length of a flexible film in the conventional art because the flexible film lies along the AB direction owing to the external pressure against the cover which is higher than the internal pressure of the same when the dam lies down. This is shown in FIG. 4(*b*).

As above, to achieve satisfactory shortening or elimination of the floating length of the film the condition $AB \geqq 1.1 \times AB$ should be satisfied. Further, the watertight sheet 3 is always kept in the state where it is in close contact with the surface of corrugation D by the internal pressure of the cover when the cover is in its expanded state and by the external pressure against the cover when the cover is in its deflated state.

If the attaching line is provided only by one row, the cover may take such an attitude as shown in FIG. 6 when the dam has lain down, so that there is no action of pressing down the cover.

Figure 5:
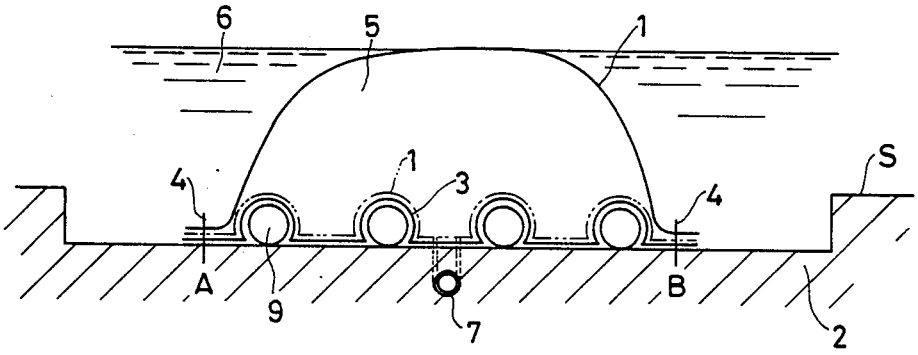

FIG. 5 shows a fourth embodiment of the present invention. Elements corresponding functionally to those in the first through fourth embodiments are designated by like reference numerals or characters. The phantom line indicates the state when the cover is deflated.

In this embodiment, instead of forming the corrugation on the foundation concrete in such a manner as shown in FIG. 4, alternatively, corrugation forming members 9 are disposed on the foundation concrete so as to provide corrugations, in combination with the foundation concrete, on the upper surface integrated with the foundation concrete.

As above, a pipe (for example, an iron pipe, a pipe of vinyl chloride, a rubber pipe, or the like), a rod, or the like, having rigidity which is large enough not to be crushed down by the depth of water at a dam location can be used. Furthermore, since the portion between attaching intervals where the corrugated surface portion integrally provided on the foundation concrete is arranged is dug down in the main body of the foundation concrete, there is no risk of damage of the film by a screw or the like because the film does not extend beyond the surface S of the body of the foundation concrete.

As described above, according to the present invention, it is possible to obtain an erecting/lying-down dam or sluice gate in which no floating film of a cover occurs, the film does not prevent a ship from navigating, and the film is never injured by a ship, even if the dam or sluice gate is used as an estuary dam, a temporarily shut-up dam, a lock gate, or the like.

What is claimed is:

1. A collapsible dam or sluice gate which is expandable upon fluid supply therein and deflatable upon fluid discharge therefrom comprising:

means for supporting said dam or gate disposed along a bottom of a river or the like having a plurality of corrugations formed integrally on an upper surface of said supporting means;

a cover made of a flexible sheet which can expand and deflate;

means for attaching said cover to said supporting means; and means for defining a lower interior surface, disposed along said upper surface of said supporting means corrugations so that said lower interior surface means has a corrugated shape and, upon discharge of said fluid, said cover is deflated to a position substantially near said corrugated shape of said lower interior surface means, and the length of a floating portion of said cover during deflation is therefore minimized.

2. A dam as in claim 1 wherein said supporting means is recessed below the bottom of the river so that said supporting means corrugations extend no higher than the bottom of the river.

3. A dam as in claim 1 wherein said supporting means is a concrete foundation.

4. A dam as in claim 2 wherein said supporting means is a concrete foundation.

5. A dam as in claim 1 wherein said attaching means further comprises first and second attaching lines each of said attaching lines forming a row of fittings extending in a transverse direction to the direction of the flow of the river or the like.

6. A dam as in claim 2 wherein said attaching means further comprises first and second attaching lines each of said attaching lines forming a row of fittings extending in a transverse direction to the direction of the flow of the river or the like.

7. A dam as in claim 5 wherein said supporting means corrugations extend substantially parallel to said first and second attaching lines.

8. A dam as in claim 6 wherein said supporting means corrugations extend substantially parallel to said attaching lines.

9. A dam as in claim 7 wherein said lower interior surface means is attached to said cover by said attaching means.

10. A dam as in claim 8 wherein said lower interior surface means is attached to said cover by said attaching means.

11. A dam as in claim 5 wherein the length between said first and second attaching lines measured along the surface of said lower interior surface means is at least 1.1 times the linear length between said first and second attaching lines.

12. A dam as in claim 6 wherein the length between said first and second attaching lines measured along the surface of said lower interior surface means is at least 1.1 times the linear length between said first and second attaching lines.

13. A collapsible dam or sluice gate which is expandable upon fluid supply therein and deflatable upon fluid discharge therefrom comprising:

means for supporting said dam or gate disposed along a bottom of a river or the like including:

a foundation having an upper surface; and corrugation-forming members attached to said upper surface of said foundation;

a cover made of a flexible sheet which can expand and deflate;

means for attaching said cover to said supporting means; and means for defining a lower interior surface, disposed along said supporting means corrugation-forming members so that said lower interior surface means has a corrugated shape and, upon discharge of said fluid, said cover is deflated to a position substantially near said corrugated shape of said lower interior surface means, and the length of a floating portion of said cover during deflation is therefore minimized.

14. A dam as in claim 13 wherein said supporting means is recessed below the bottom of the river so that said corrugation-forming members extend no higher than the bottom of the river.

15. A dam as in claim 14 wherein said supporting means foundation is concrete.

16. A dam as in claim 14 wherein said corrugation forming members are rod-like members having rigidity which is large enough to withstand the water pressure at the desired depth of use of the dam.

17. A dam as in claim 14 wherein said upper surface of said supporting means foundation is approximately planer.

18. A dam as in claim 14 wherein said attaching means further comprises first and second attaching lines each of said attaching lines forming a row of fittings extending in a transverse direction to the direction of the flow of the river or the like.

19. A dam as in claim 18 wherein said corrugation-forming members extend substantially parallel to said first and second attaching lines.

20. A dam as in claim 19 wherein said lower interior surface means is attached to said cover by said attaching means.

21. A dam as in claim 18 wherein the length between said first and second attaching lines measured along the surface of said lower interior surface means is at least 1.1 times the linear length between said first and second attaching lines.

* * * * *